US008439207B2

(12) United States Patent
Currin

(10) Patent No.: US 8,439,207 B2
(45) Date of Patent: May 14, 2013

(54) DRAPERY DISPLAY HANGER

(75) Inventor: Jim Currin, Norcross, GA (US)

(73) Assignee: Newell Window Furnishings, Inc., High Point, NC (US)

( * ) Notice: Subject to any disclaimer, the term of this patent is extended or adjusted under 35 U.S.C. 154(b) by 22 days.

(21) Appl. No.: 13/151,910

(22) Filed: Jun. 2, 2011

(65) Prior Publication Data

US 2012/0305504 A1 Dec. 6, 2012

(51) Int. Cl.
*A47F 7/16* (2006.01)

(52) U.S. Cl.
USPC ..... 211/45; 211/46; 211/106.01

(58) Field of Classification Search ..... 211/45–48, 211/50, 105.1, 106.01, 189, 123, 190–192, 211/183; 312/184
See application file for complete search history.

(56) References Cited

U.S. PATENT DOCUMENTS 2,023,866 A * 12/1935 Best ..... 211/48
2,848,163 A * 8/1958 Van Horne Serrell ..... 235/487
3,200,960 A * 8/1965 Banse ..... 206/459.5
3,899,842 A * 8/1975 Shneider ..... 40/379
4,037,729 A * 7/1977 DeSisto ..... 211/208
4,583,648 A * 4/1986 Buffington et al. ..... 211/90.03
4,936,565 A * 6/1990 Fredrickson ..... 211/59.1
5,678,794 A * 10/1997 Kump ..... 248/220.31
5,845,794 A * 12/1998 Highsmith ..... 211/189
6,101,773 A * 8/2000 Chau et al. ..... 52/220.7
6,105,798 A * 8/2000 Gruber et al. ..... 211/151
6,860,456 B2 * 3/2005 Magnusson ..... 248/215
7,614,511 B2 * 11/2009 Konstant ..... 211/189

* cited by examiner

*Primary Examiner* — Korie H Chan
(74) *Attorney, Agent, or Firm* — Andrew D. Gerschultz; Moore & Van Allen PLLC

(57) ABSTRACT

The drapery display hanger comprises a plurality of drapery arms and a support surface. The support surface can be easily and reversibly mounted to a pre-existing display fixture without the need for special hardware. The support surface can include brackets having opposing surfaces angled from vertical for ease of installation and protrusions for securing the support surfaces in place once installed. Additionally, the drapery arms can be reversibly attached to the support surface using attachment devices at the end of each arm. The attachment devices may include segments that are inserted into the holes in the support and then secured against the walls of the support for bearing the weight of drapery on the drapery arms. Sliding and pivoting functionality is also provided. The drapery arms are sized so that full-sized draperies can be displayed facing the customer and without compressing the drapery in the display.

16 Claims, 8 Drawing Sheets

DRAPERY DISPLAY HANGER

The invention relates generally to window coverings such as draperies and more particularly to an improved display hanger for draperies.

BACKGROUND OF THE INVENTION

In a standard drapery display, the display hanger is a straight swing arm attached at one end to a support surface. Typically, the swing arm is attached to the support surface by a bracket that allows the swing arm to move laterally. In some cases, multiple swing arms are arranged side-by-side on the support surface in an attempt to efficiently use space. Draperies are placed on top of the swing arms or threaded onto the swing arms for display. Depending on the type of drapery, the desired aesthetic look, the structure of the support surface, the available space, and other factors, the length of the straight swing arm may vary.

Standard swing arms typically include twelve inches of hanging surface. Swing arms are often limited to twelve inches of hanging surface because of size constraints in display settings and because longer swing arms apply high forces on the bracket. Twelve inches of hanging surface, however, is not long enough to display standard sized drapery. As a result, either the standard sized drapery must be compressed on the display hanger, resulting in a poor aesthetic display, or specially manufactured small samples must be used, resulting in increased cost.

Further, in order for a customer to view the drapery displayed on the swing arm, the customer must shuffle through multiple swing arms. This entails moving each swing arm to the side so that the customer can inspect the drapery before moving to another swing arm. Thus, the customer cannot view all of the draperies arranged side-by-side without a time-consuming search. Many customers may be unwilling to do this and will bypass the drapery display without viewing all of the draperies.

Finally, the lateral movement of the swing arms results in deficiencies in the design. For example, the brackets may be more likely to break because of the moving parts. The movable brackets are able to support less weight than a bracket immovably attached to a support bar. Additional space is required on either side of the support to allow the swings arms on either end of the display to swing laterally passed the display ends. The swing arms also make it difficult to mount the drapery display on pre-existing shelving.

Thus an improved drapery display hanger is desired.

SUMMARY OF THE INVENTION

According to one embodiment of the invention, the drapery display hanger of the invention comprises a drapery arm and a support that can be mounted to pre-existing display fixtures. The support includes brackets on either end for attaching to pre-existing display fixtures. Three examples of brackets are included herein, although it should be understood that the types of brackets are not limited to these examples. In some embodiments, the drapery arm is adjustable and removable from the support. The drapery arm may be U-shaped and provide approximately twenty-seven inches of hanging surface. The drapery arm includes a display end, two lateral arms attached to the display end, and attachment devices on an opposing end of each lateral arm. The attachment devices may be fixed to the support or removable. When removable, the attachment devices provide for customizable display of draperies wherein the draperies are securely supported, fully displayed without requiring effort by the customer, and efficiently use space.

DETAILED DESCRIPTION OF EMBODIMENTS OF THE INVENTION

Figure 1:
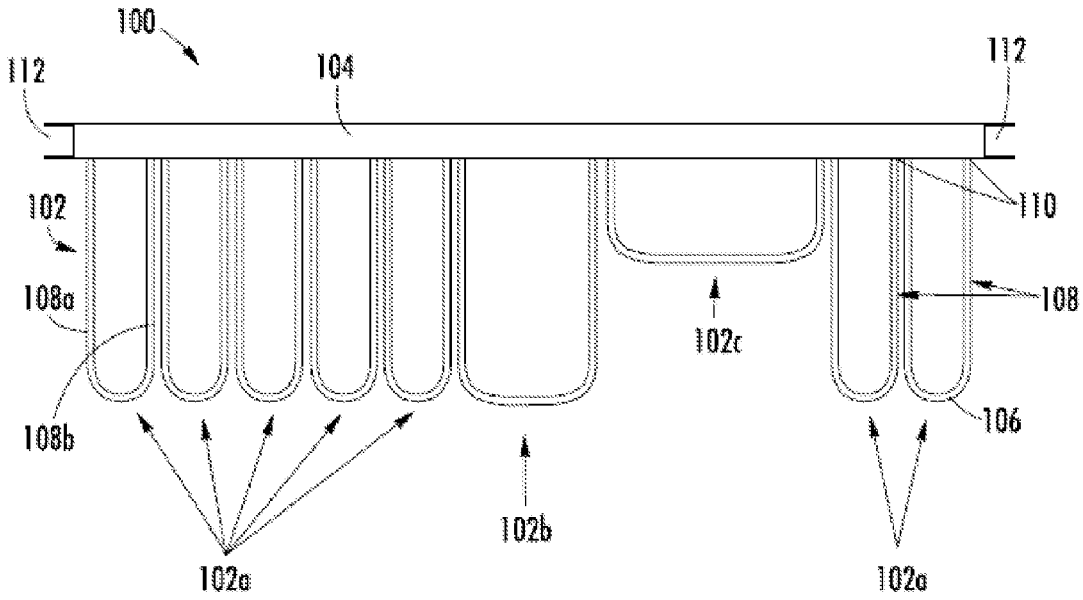
FIG. 1 is a top view of an embodiment of the drapery display hanger of the invention.
Figure 2:
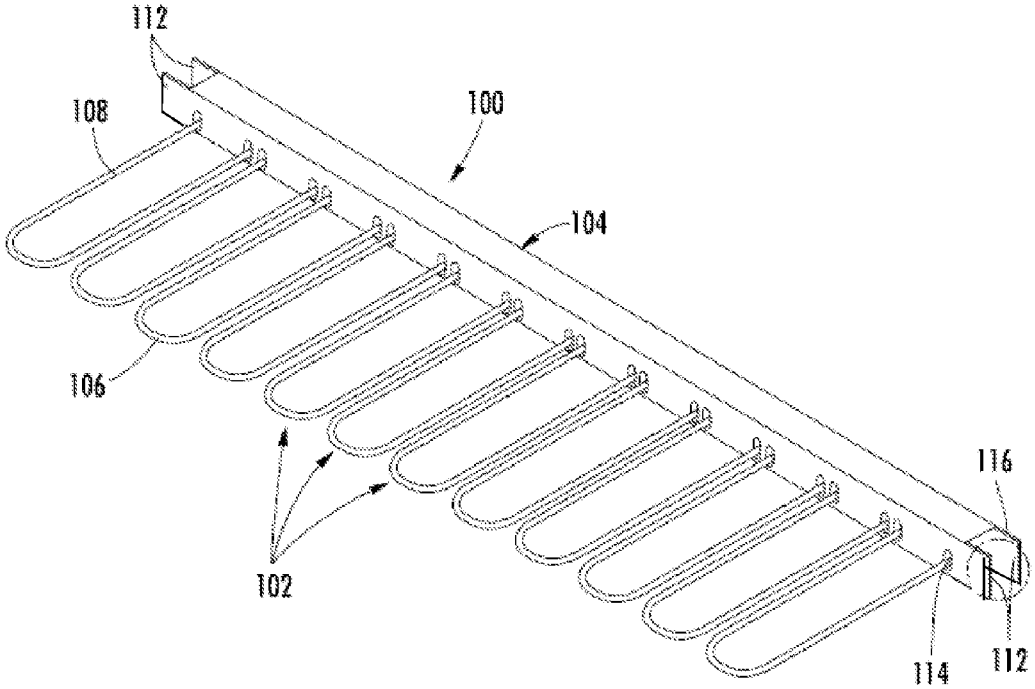
FIGS. 2, 2A, 2B, and 2C are perspective views of the drapery display hanger of FIG. 1 including three detail views of embodiments of the brackets on the support.

One embodiment of the drapery display hanger of the invention is shown generally at 100 in FIGS. 1 and 2 and comprises a plurality of drapery arms 102 and a support 104. The drapery arms 102 may be identical such that the structure of the arms will be described with respect to one of the arms. The drapery arm 102 has a display end 106, two lateral arms 108, and two attachment devices 110. The display end 106 connects the first lateral arm 108*a* and the second lateral arm 108*b* such that the first lateral arm 108*a* and second lateral arm 108*b* are substantially parallel and include a space between them. In the illustrated embodiment, the drapery arm 102 is generally U-shaped, although other shapes may be formed according to other embodiments. The lateral arms 108 can be formed integrally with the display end 106 such that a single piece of material is used to create the drapery arm 102. For example, the display end 106 and lateral arms 108 may be formed as a bent wire form. Alternatively, the lateral arms 108 can be attached to the display end 106 by welding, adhesive, or other attachment means. The display end 106 may be curved or squared off. A curved display end 106 is capable of displaying visually pleasing waves of drapery while minimizing the amount of front retail space. The lateral arms 108 opposite to display end 106 terminate in free ends that include the attachment devices 110. The attachment devices 110 at the end of each of the lateral arms 108 attach the drapery arm 102 to the support 104. In some embodiments, the attachment devices 110 are configured to allow the drapery arm 102 to be removable from the support 104. In another embodiment, the attachment devices 110 are configured to fixedly attach the drapery arm 102 to the support 104, as will hereinafter be described.

The drapery arm 102 provides preferably between about twenty inches and about thirty inches of hanging surface; and most preferably the drapery arm 102 provides about twenty seven inches of hanging surface. It is appreciated however that the aforementioned hanging surface lengths are provided as example ranges only and that, in other embodiments, the hanging surface may be greater than or less than that which is explicitly stated herein without departing from the spirit of the invention. It has been found that twenty seven inches of hanging surface efficiently uses space but allows the display of full size draperies. A U-shaped drapery arm 102 allows a drapery to be appropriately displayed without compressing the drapery but also advantageously protrudes approximately only half the length of the hanging surface from the pre-existing display fixture. For example, a drapery arm 102 that provides twenty seven inches of hanging surface extends from support 104 less than thirteen inches. Similarly, drapery display hangers 100 having at least twenty inches of hanging surface allow various sized draperies to be displayed on the drapery display hanger 100 without the need to compress the drapery. Instead, the draperies will appear as they would appear in the customer's home or business.

Draperies may be displayed on the drapery display hanger 100 by laying the drapery over the top of the display arm 102, using hooks to attach the drapery to the display arm 102, or detaching the display arm 102 from the support 104 and threading the display arm 102 through a sleeve created in the top of the drapery. Depending on the length of the drapery relative to the hanging surface of the drapery arm 102, the drapery can be spread out as the drapery would appear when the drapes were closed in a home or business or the drapery can be arranged as the drapery would appear when the drapes were open in the home or business. This gives the customer the opportunity to view drapery in both use configurations for the home or business.

The hanging surface of the drapery arm 102 includes the length of both of the lateral arms 108*a*, 108*b* and the length of the display end 106. The display end 106 is oriented so that the drapery on the drapery arm 102 is displayed to the customer. The length of the lateral arms 108 and the display end 106 can vary in size. While the Figures depict the lateral arms 108 as longer than the display end 106, this is not required. The drapery arms may be configured so that a larger portion of the drapery is displayed on the display end 106 than on the lateral arms 108. The potential variability in the length of the drapery arms allows for flexibility in designing drapery displays where space is limited or different size draperies are included. As depicted in FIG. 1, multiple drapery arms 102 can be included in a drapery display hanger 100. The drapery arms 102 can be arranged side-by-side on the support 104 or spaced irregularly on the support. Different size drapery arms 102*a*, 102*b*, 102*c* can be arranged on the same support 104.

In some embodiments, the support 104 is a rectangular or round rigid bar having holes 114 in at least one side and brackets 112 on each end. The support 104 includes brackets 112 for attaching to pre-existing display fixtures as well as holes 114 for receiving the attachment devices 110 on the drapery arm 102. The support 104 is preferably between about twenty inches and ninety inches long; more preferably between about forty and sixty inches long; and most preferably about forty-eight inches long. It is appreciated however that the aforementioned support lengths are provided as example ranges only and that, in other embodiments, the support may be greater than or less than that which is explicitly stated herein without departing from the spirit of the invention. In an embodiment, the support 104 is designed so that the length of the support 104 coincides with the length of pre-existing display fixtures in stores. This facilitates installation of the drapery display hanger 100 on pre-existing display fixtures. The holes 114 in the bracket can be regularly spaced or specially spaced to display specific types of drapery, e.g., very large drapes may benefit from holes spaced a larger distance apart than is depicted in the Figures. The distance between the holes 114 can be configured so that each hole is used when the drapery arms 102 are attached to the support 104. In another embodiment, a plurality of holes 114 can be formed intermediate to the holes as configured in FIG. 2. Having a greater number of holes 114 on the support 104 than is depicted in FIG. 2 allows for flexibility in designing drapery displays. The diameter of the holes is shaped to closely receive the attachment devices 110 of the drapery arms 102, as will be described.

Figure 2A:
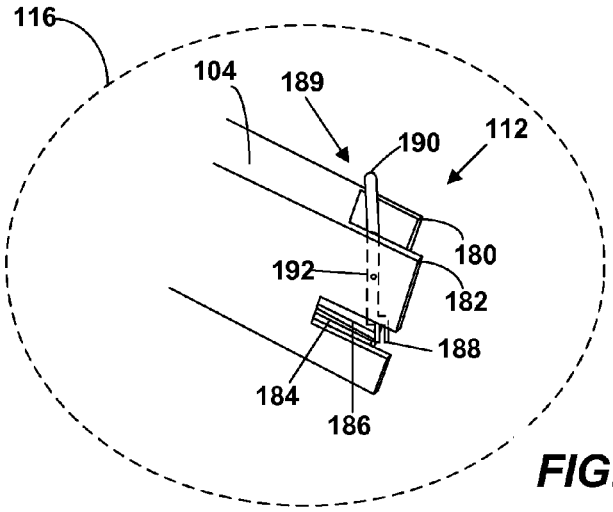
Figure 2B:
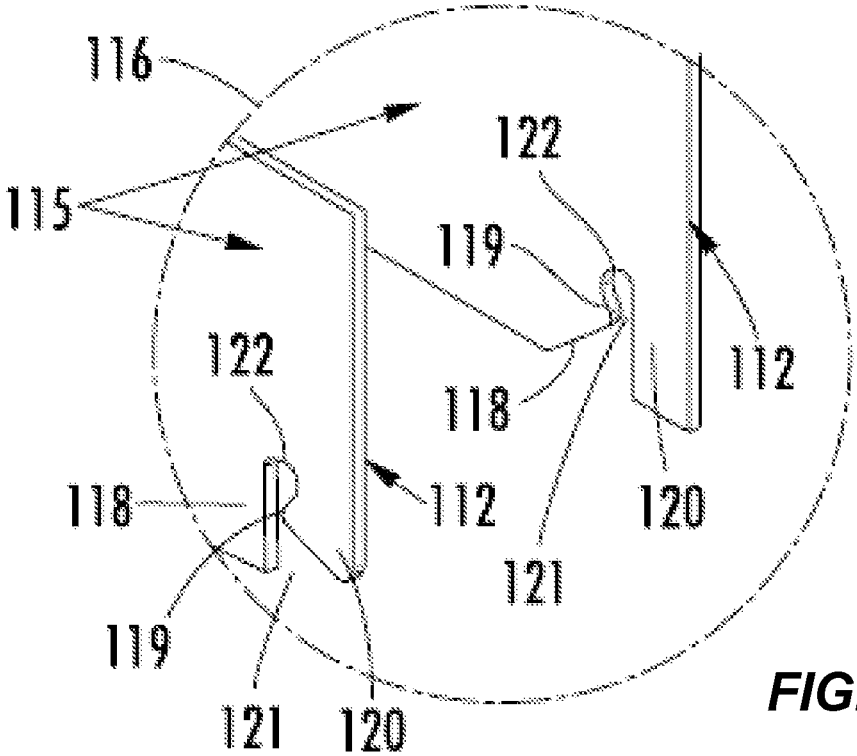
Figure 2C:
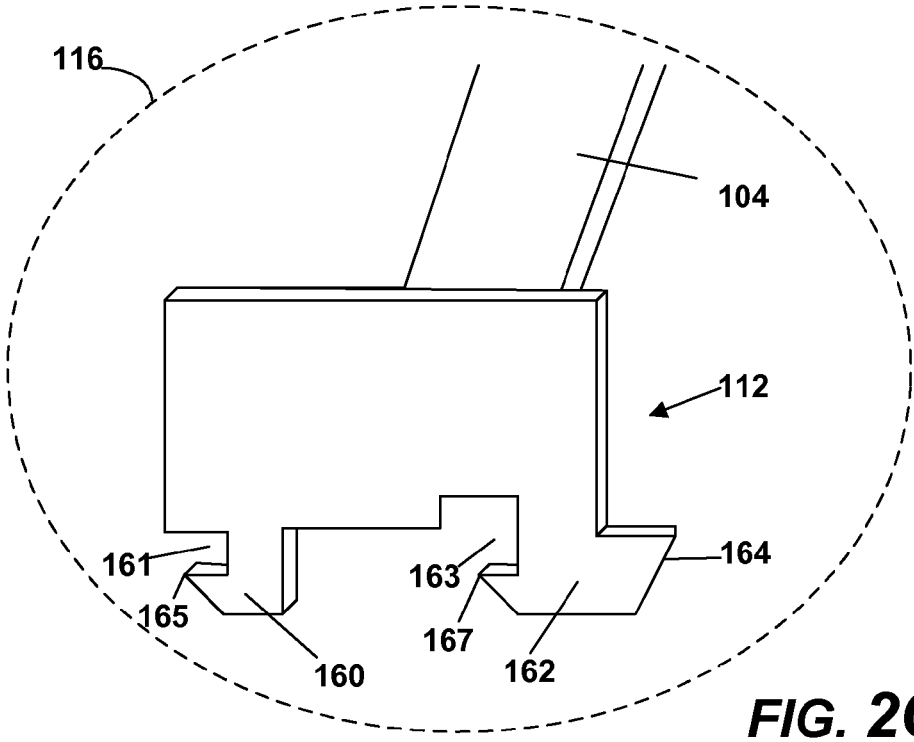
Figure 3:
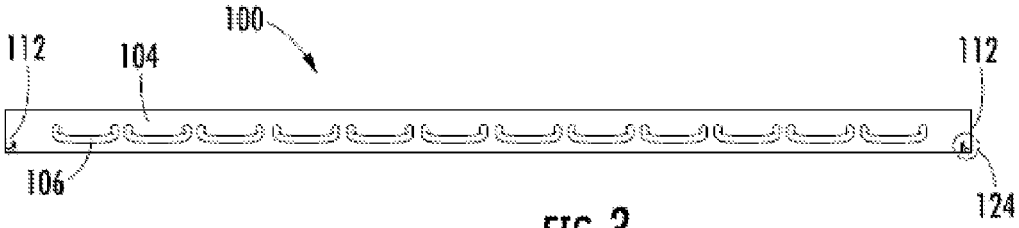
FIG. 3 is a front view of the drapery display hanger of FIG. 1.

As shown in FIGS. 2 and 3, the support 104 is attached to pre-existing display fixtures by the brackets 112. Three different embodiments of the brackets 112 are provided in FIGS. 2A, 2B, and 2C as examples. Callout 116 in each of FIGS. 2A, 2B, and 2C indicates a detail view of a different type of bracket 112 that may be used on the end of the support 104. It should be understood that these brackets are not limiting to the types of brackets that can be used.

In an illustrated embodiment in FIG. 2A, the brackets 112 include a horizontal slot for receiving a portion of the pre-existing display fixture. For example, the support 104 may include brackets 112 that slide onto a wire frame. The brackets 112 can include a first edge 180 and a second edge 182 defining an opening between them. Both the first edge and the second edge 180, 182 include a slot 184, 186 (e.g., a horizontal slot) for receiving a grid wire from a pre-existing display fixture. In an embodiment, both ends of the support 104 include brackets 112 with slots 184, 186. To install the drapery display hanger 100, the bracket 112 on one end of the support 104 is slid onto a grid wire so that the grid wire is received within the slot and then the other end is installed similarly on a second grid wire. In an embodiment, the slots 184, 186 are wide enough to allow the support 104 to extend over the grid wire so that the second end of the support 104 can be installed on the second grid wire.

In another embodiment depicted in FIG. 2A, one or both brackets 112 on the support 104 also include a locking mechanism 189 comprising a handle 190, a receiver 188, and a pivot point 192. The locking mechanism 189 reversibly locks the grid wire into the slots 184, 186. The locking mechanism 189 pivots around the pivot point 192, which can be a rotating screw or the like, such that when the user manipulates the handle 190 the receiver 188 raises or lowers relative to the slots 184, 186. The receiver 188 is configured to receive the grid wire, e.g., the receiver may have an opening that traps the grid wire and prevents it from moving laterally within the slots 184, 186 when the locking mechanism 189 is in a locking position. Here, the locking mechanism 189 is depicted as locking the grid wire when the trigger 190 is pulled away from the center of the support 104 such that the receiver 188 moves downward relative to the slot and traps the grid wire. The locking mechanism 189 can be released by advancing the trigger 190 toward the center of the support 104 so that the receiver 188 rises up and releases the grid wire.

Figure 3A:
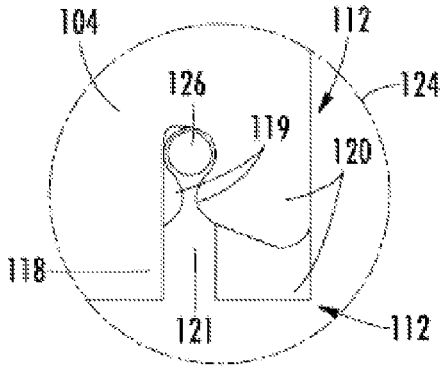
FIG. 3A is a detail view of the drapery display hanger of the invention showing an embodiment of the brackets attached to a pre-existing display fixture.

Callout 116 in FIG. 2B and callout 124 in FIG. 3A depict a detail view of another embodiment of the bracket 112 for attaching to the pre-existing display fixtures. In this embodiment, the bracket 112 includes a clip profile for capturing a grid wire and locking the support in place. The bracket 112 comprises a receptacle 122 defined by first and second opposing surfaces 118, 120 formed at the lower edge end of the bracket 112. The first opposing surface 118 is closer to the center of the support 104 than the second opposing surface 120. The first and second opposing surfaces 118, 120 open to form a notch 121 configured to receive a portion of the grid wire 126.

In the illustrated embodiment, an alternating clip profile is provided wherein the first and second opposing surfaces 118, 120 alternate between a slanted surface and a flat surface on opposing edges of the support 104 to define the receptacles 122 on both edges of the support 104, as shown in FIGS. 2B and 3A. In the illustrated embodiment, the first and/or second opposing surfaces 118, 120 include a protrusion 119 that partially encloses the receptacle 122. When the pre-existing display fixture is inserted into the receptacle 122, the protrusions 119 on both edges of the bracket 112 trap the display fixture and secure the pre-existing display fixture in place.

In one embodiment, the first and second opposing surfaces 118, 120 can be vertical or angled from vertical. In some embodiments, the bracket 112 includes two receptacles 122 defined on opposing walls 117 of the support 104, as shown in FIGS. 2B and 3A, although a single bracket and receptacle may be used. The first opposing surfaces 118 on both edges of the support 104 may be vertical or angled from vertical. Further, the second opposing surfaces 120 on both edges of the support 104 may be vertical or angled from vertical. By angling one or both of opposing surfaces 118, 120, a portion of the pre-existing display fixture, such as grid wire 126, may be more easily captured and guided through the notch 121 and into the receptacle 122 for ease of installation. In an alternate embodiment (not shown) the notch 121 and receptacle 122 may be wide enough to loosely receive support bars on pre-existing display fixtures.

To install the support 104 on the pre-existing display fixture, the brackets 112 are placed on the grid wire 126 and the support 104 is pressed downward. The opposing surfaces 118 or 120 direct the grid wire 126 through the notch. Sufficient pressure is applied to deform the protrusion 119 and/or grid wire 126 and allow the grid wire 126 to enter the receptacle 122, at which point the protrusion 119 secures the support 104 to the pre-existing display fixture. To remove the support 104 from the pre-existing display fixture, sufficient pressure must be used to separate the support 104 from the display fixture so that the protrusions 119 and/or grid wire 126 deforms to allow the grid wire 126 to exit the receptacle 122.

FIG. 2C depicts another embodiment of the bracket 112 that allows the drapery display hanger 100 to attach to Lozier™ type supports. The bracket 112 includes a first hook 160 and a second hook 162 that attach to pre-existing display fixtures. Both the first hook 160 and the second hook 162 define recesses 161 and 163 for receiving a pair of wires or bars associated with the pre-existing display fixture. The second hook also includes a front protrusion 164 for bracing the support 104 against a countervailing wire or bar on the pre-existing display fixture. To install the support 104 on the pre-existing display fixture, the front protrusion 164 is biased against the wire on the pre-existing display fixture and then the first and second hooks 160, 162 are pushed downward to deform the tips 165, 167 of the first and second hooks 160, 162 until the wire are received into the recesses 161, 163

It should be understood that the examples disclosed herein are not limiting to the types of brackets that can be used to attach the support 104 to the pre-existing display fixture. For example, the brackets 112 may be a single hook that attaches to a bar or the brackets 112 may include screws and bolts for securing the support to a pre-existing display fixture. The brackets 112 may also attach the support to other than pre-existing display fixtures. In another embodiment (not shown), the support 104 may be slideably or pivotably attached to a pre-existing display fixture or another surface, e.g., a wall, etc.

In another embodiment, one or both ends of the support 104 are pivotably attached to the pre-existing display. The bracket 112 may secure to the pre-existing display fixture but include a lateral pivot that allows the support 104 to swing laterally. For example, a pivot hinge may attach to one end of the support 104. When the support 104 is swung outwards so that the second end of the support 104 is not attached to the pre-existing display fixture, the user can easily attach drapery arms 102 to the support 104. Allowing the support to move laterally based on a pivot hinge between the display fixture and the support also allows customers to view both the front and the back of the draperies hung on the support 104. Further, allowing pivoting of the support 104 from the pre-existing display allows the user to display tiers of draperies. Rows of draperies displayed on drapery display hangers can be placed in front of another and pivoted out of the way when the customer desires to view draperies in back rows. It should be understood that the examples disclosed for pivotably attaching the support 104 to the display fixture are not limiting.

Figure 4:
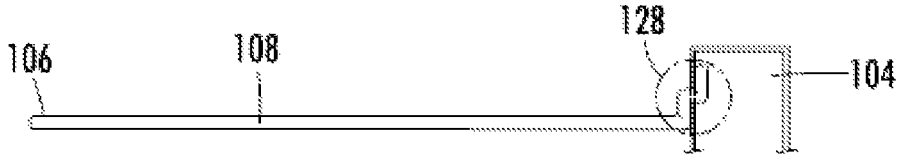
FIG. 4 is a side view of an embodiment of the drapery arm of FIG. 1.

In an embodiment depicted in FIG. 4, the drapery arms 102 are attached to the support 104 by the attachment devices 110 mating with the holes 114 in the support 104. Callout 128 depicts a detail view of the attachment device 110 attached to the support 104, wherein the support 104 is shown in cross-section. The lateral arm 108 terminates in an attachment device comprising a first segment 130, a second segment 132, and a third segment 134. In an embodiment, the first segment 130 is disposed approximately perpendicular to the lateral arm 108 and extends for a first distance. The second segment 132 is disposed approximately perpendicular to the first segment 130 and extends away from the lateral arm 108 for a second distance sufficient to pass through the wall 117 of the support 104. The second segment 132 is substantially parallel with the lateral arm 108. The third segment 134 is disposed approximately perpendicular to the second segment 132 and extends for a third distance substantially parallel to the first segment 130. The attachment device 110 removably connects the drapery arm 102 to the support 104 so that the drapery arm 102 can bear the weight of the drapery.

Figure 4A:
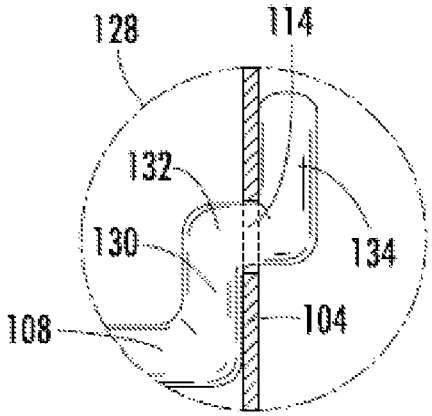
FIG. 4A is a detail partial section view of the attachment device of the drapery arm of FIG. 4.
Figure 7:
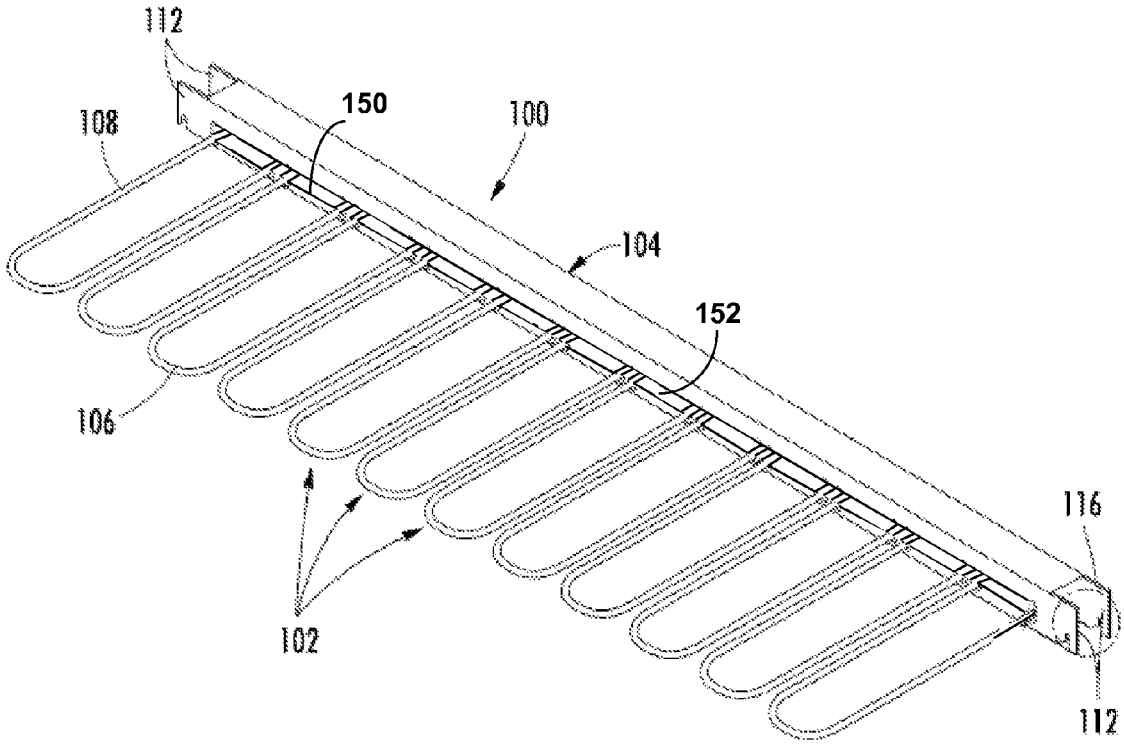
FIG. 7 is a perspective view of a third embodiment of the drapery display hanger of the invention.

The embodiment depicted in FIG. 4A does not limit the type of attachment devices 110 that can be used to attach the drapery arms 102 to the support 104. FIG. 7 depicts an embodiment wherein the displays arms 102 are not fixed to a single location on the support 104. For example, the attachment devices 110 may be shaped to fit within a lateral rail 150 running at least some portion of the length of the support 104. The opening 152 defined by the rail allows the drapery arms 102 to be positioned at any point along the support 104. The attachment devices can be configured to be inserted into the opening 152 in the support 104 and then moved laterally along the rail 150. Optionally, the support 104 can have a rail 150 opening up onto at least one end of the support 104 and for a portion of the length of the support 104. The user can insert the attachment 110 devices at the end of the support 104 and position them at any distance along the support 104 for ease in designing drapery displays. Once the drapery arms 102 are positioned on the support 104, the user can attach the support 104 to the pre-existing display fixtures. Additionally, other examples of attachment devices 110 to attach the display arms 102 to the support 104 include braces, screws, and bolts.

In another embodiment, the attachment devices 110 provide a pivoting mechanism when attaching the drapery arms 102 to the support 104. The attachment devices may pivot upwards or downwards. This allows a drapery display hanger to display draperies of different heights on the same support while maintaining all of the draperies the same distance from the ground. Customers, when viewing drapes for purchase, desire to see the drapes in a position similar to how the drapes will be displayed in the customer's home or business. A pivoting drapery arm 102 allows a drape that is inches longer than another drape to be displayed side by side with the shorter drape while displaying the bottom edge of both draperies the proper distance from the floor. One example of a providing pivoting functionality is to include a pivot point between the first segment 130 and the second segment 132 and to include a second pivot point between the second segment 132 and the third segment 134. The angle between the first segment 130 and the second segment 132 can be greater or less than approximately 90 degrees, as can the angled between the second segment 132 and the third segment 134. By modifying these angles, the attachment devices 110 may vary the angle of the drapery arm 102 relative to the support 104. As should be understood, the pivot points can be accomplished by a variety of means, such as geared pivots, pin and joint pivots, or the like. These examples are not intended to be limiting.

Figure 5A:
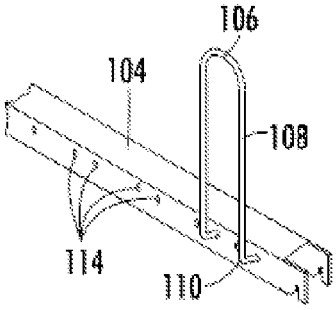
FIGS. 5A, 5B, and 5C show the attachment of the display arm to the support, in accordance with an embodiment of the invention.
Figure 5B:
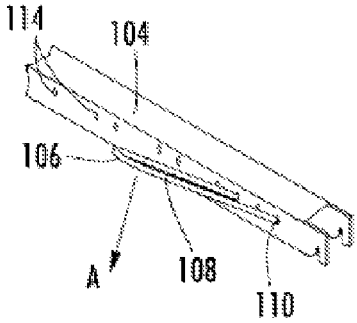
Figure 5C:
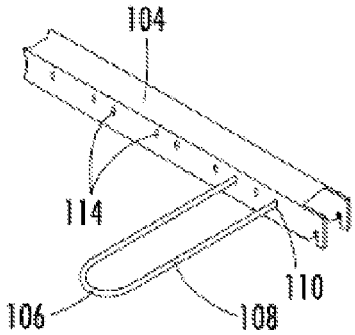

FIGS. 5A, 5B, and 5C depict a method of attaching the drapery arm 102 to the support 104. In FIG. 5A, the drapery arm 102 is oriented so that the third segment 134 is able to enter the holes 114 in the support 104. The third segment 134 is pushed into the holes 114 in the support 104 until the second segment 132 contacts the support 104. At this point, as depicted in FIG. 5B, the drapery arm 102 is angled downward so that the second segment 132 is able to pass through the hole 114 until the first segment 130 contacts the support 104. When the first segment 130 contacts one side of the support 104 and the third segment 134 contacts an opposite side of the support 104, the drapery arm 102 is securely attached to the support 104 by the third segment 134 contacting the back of the wall 115 of support 104 and the first segment 130 contacting the front of the wall 115 of support 104, as in FIG. 5C. When a weight is applied to the drapery arm 102, the first segment 130 is rotated against the front of wall 115 of the support 104 and the third segment 134 is rotated against the back of the wall 115 of the support 104, such that the drapery arm 102 is supported in a substantially horizontal position. The drapery arm 102 can be removed from the support 104 by reversing the process. A drapery can be threaded onto the drapery arm 102 before the drapery arm 102 is attached to the support 104 or drapery rings can be slipped onto the drapery arm 102. The user may remove the drapery arm 102 from the support 104 by lifting the display end 106 of the drapery arm 102 upwards so that the third segment 134 angles downward and is oriented inline with the hole 114. The drapery arm 102 is then disconnected from the support by pulling the drapery arm 102 away from the support 104. Drapery can be threaded onto the drapery arm 102 and then the attachment devices 110 can again be attached to the support 104 by inserting the third segments 134 into the holes 114 and angling the drapery end 106 down in the direction of Arrow A.

Figure 6:
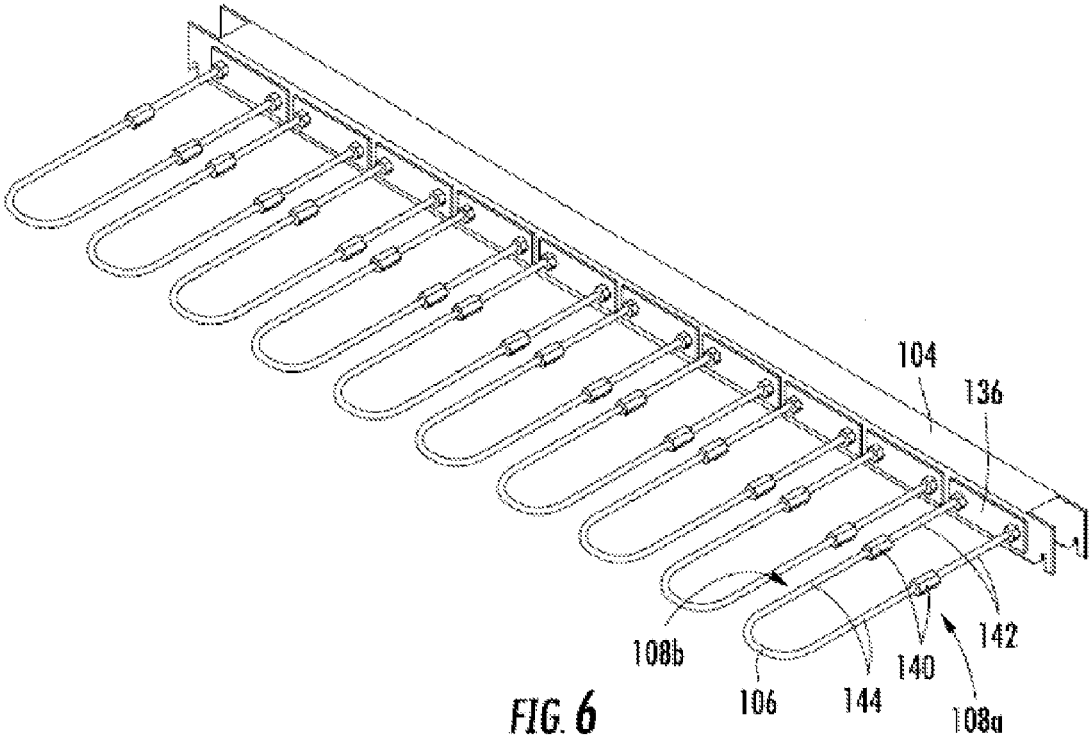
FIG. 6 is a perspective view of a second embodiment of the drapery display hanger of the invention.

A second embodiment of the drapery display hanger 100 is depicted in FIG. 6. The drapery arm 102 is permanently or semi-permanently attached to the support 104 by a backplate 136. For example, the backplate 136 may be attached to the support 104 by screws, nails, or other permanent or semi-permanent means. Because the backplate 136 is not intended to be easily removed from the support 104, a releasable connector 140 is provided on a first lateral arm 108*a* and a second lateral arm 108*b* to allow drapery to be threaded onto the drapery arm 102. A first portion 142 of the first lateral arm 108*a* is permanently connected to the backplate 136 at one end. A second portion 144 of the first lateral arm 108*a* is connected to the opposite end of the first portion 142 by the releasable connector 140. Similarly, a first portion 142 of the second lateral arm 108*b* is permanently connected to the backplate 136 at one end. A second portion 144 of the second lateral arm 108*b* is connected to the opposite end of the first portion 142 of the second lateral arm 108*b* by another releasable connector 140. The releasable connectors 140 allow the second portions 144 of the first and second lateral arms 108*a*, 108*b* attached to the display end 106 to be detached from the first portions 142, backplate 136, and support 104. When the second portion 144 and display end 106 is detached, the drapery can be threaded onto the second portions 144 and the display end 106 and the releasable connectors 140 can be reconnected. In an embodiment, the releasable connectors 140 are a screw on one of the first or second portions 142, 144 and a mated threaded portion on the other of the first or second portions 142, 144. The screw can be tightened onto the threaded portion to attach the display end 106 to the backplate 136. Other types of releasable connectors 140 are possible. For example, the releasable connector 140 may be a cam buckle, snap fit connector connector, a male-female connector, a prong-type connector, or other type of releasable connector 140.

Figure 8:
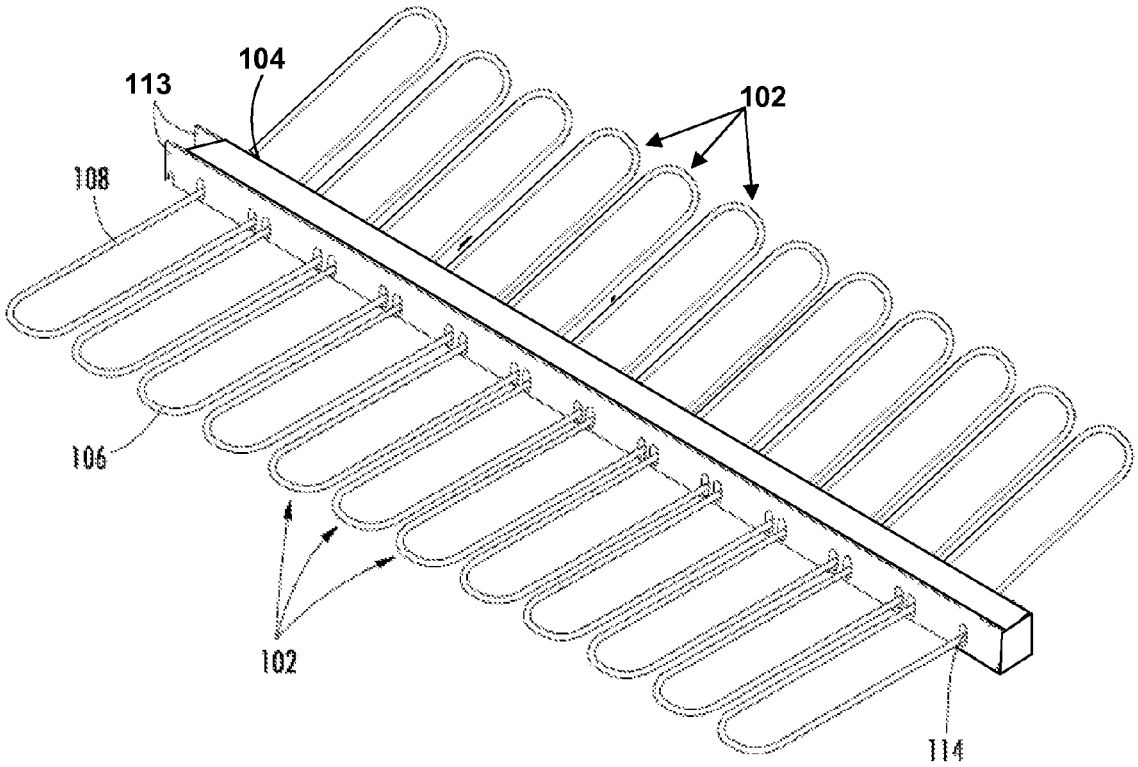
FIG. 8 is a perspective view of a fourth embodiment of the drapery display hanger of the invention.

While examples of the support 104 are disclosed herein as round or rectangular rigid bars attached at both ends to the pre-existing display fixture, it should be understood that other types of supports 104 are possible. In an additional embodiment depicted in FIG. 8, the support 104 is attached at one end 113 to a display fixture such that the support 104 protrudes out from the display fixture. This design has the additional advantage of allowing drapery arms 102 to be attached to both sides of the support 104 and draperies to be displayed on both sides. In an additional embodiment (not shown), the support 104 is configured as an island. The support 104 can be constructed as a round or rectangular structure with display arms 102 radiating outwards so that draperies are attractively displayed in a self-contained unit. In another embodiment (not shown), the support 104 does not need to be a separate structure from the display fixture. For example, the drapery arms 102 may attach directly to a display fixture. In another embodiment, the drapery arms 102 are configured to attach to a wall. For example, the drapery arms 102 may attach to the wall by conventional screws or bolts and include a releasable connector 140, as described previously.

The drapery display hanger 100 may be constructed of aluminum, metal alloy, plastic, or any other material suitable for display. Preferably, the drapery display hanger 100 includes material strong enough to support heavy draperies while the draperies are being examined by customers. One skilled in the art would know types of material from which the drapery display hanger 100 can be constructed.

Advantages of the drapery display hanger include efficient use of space, attractive display of draperies, and customization of display space. The users of the drapery display hanger are able to display a high number of drapery products within a relatively compact retail shelf space. At the same time, the draperies are appropriately displayed without compressing and at the correct height. Further, the drapery display hanger allows customization by the user so that the draperies can be displayed in a variety of pre-existing display fixtures. Finally, the drapery arms can be varied in size, in location along the support, and at various heights. These advantages of the drapery display hanger are clear upon consideration of the disclosure herein.

While embodiments of the invention are disclose herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A drapery display hanger comprising:

a plurality of drapery arms comprising a first lateral arm, a second lateral arm, and a display end connecting the first lateral arm and the second lateral arm such that the lateral arms are spaced apart from one another, wherein the first and second lateral arms of each of the plurality of drapery arms are arranged to extend outwardly from a place defined by a support surface, and wherein each of the plurality of drapery arms are spaced apart along the support surface, wherein the support surface comprises a support for attaching to a pre-existing display fixture, the support comprising a first bracket at a first end of the support and a second bracket at a second end of the support, wherein each of the first and second brackets comprise a first edge and a second edge, wherein each of the first edge and the second edge include a first opposing surface and a second opposing surface, wherein the first opposing surface and the second opposing surface on the first edge and the second edge define a receptacle, wherein the first opposing surface on the first edge is vertical and the second opposing surface on the first edge is angled from vertical, wherein the first opposing surface on the second edge is angled from vertical and the second opposing surface on the second edge is vertical, and wherein the first edge on the first opposing surface and the first edge on the second opposing surface are positioned on one side of the receptacle.

2. The drapery display hanger of claim 1, wherein each of the drapery arms further comprise a first attachment device and a second attachment device, wherein the first attachment device is attached to a first free end of the first lateral arm and wherein the second attachment device is attached to a second free end of the second lateral arm.

3. The drapery display hanger of claim 2, wherein the first attachment device and the second attachment device comprise a first segment, a second segment, and a third segment, wherein the first segment and the third segment are substantially parallel, and wherein the lateral arms and the second segment are substantially parallel.

4. The drapery display hanger of claim 1, wherein the first lateral arm and the second lateral arm are substantially parallel.

5. The drapery display hanger of claim 1, wherein each of the drapery arms are removable from the support surface.

6. The drapery display hanger of claim 1, wherein the first and second brackets further comprise a protrusion for securing the pre-existing display fixture into the receptacle.

7. The drapery display hanger of claim 1, wherein the support surface includes a plurality of holes for receiving more than one drapery arm.

8. The drapery display hanger of claim 1, wherein the first and second lateral arms include a screw and matched threaded portion for releasably connecting the display end to the support surface.

9. The drapery display hanger of claim 1, configured so that drapery is supported on the display end without compressing the drapery.

10. The drapery display hanger of claim 1, wherein the support surface is of a length configured to match the pre-existing display fixture.

11. The draper display hanger of claim 1, wherein the drapery arm provides hanging space of greater than twenty inches.

12. The drapery display hanger of claim 1, wherein the first lateral arm comprises a first portion and a second portion connected by a first releasable connector, and wherein the second lateral arm comprises a first portion and a second portion connected by a second releasable connector.

13. The drapery display hanger of claim 12, wherein the first and second releasable connectors comprise male and female connectors.

14. The drapery display hanger of claim 12, wherein the first portion of the first lateral arm and the first portion of the second lateral arm are connected to a backplate.

15. A method of displaying drapery on a pre-existing display fixture, the method comprising:

providing a plurality of drapery arms for mounting to a support surface, the drapery arm including a display end and two lateral arms, wherein the lateral arms are spaced apart;

attaching the plurality of drapery arms to a support surface so that the drapery arms extend outward from a plane defined by the support surface, and attaching the support surface to a pre-existing display fixture, the support surface comprising a first bracket at a first end of the support surface and a second bracket at a second end of the support surface, wherein each of the first and second brackets comprise a first edge and a second edge, wherein each of the first edge and the second edge include a first opposing surface and a second opposing surface, wherein the first opposing surface and the second opposing surface on the first edge and the second edge define a receptacle, wherein the first opposing surface on the first edge is vertical and the second opposing surface on the first edge is angled from vertical, wherein the first opposing surface on the second edge is angled from vertical and the second opposing surface on the second edge is vertical, and wherein the first edge on the first opposing surface and the first edge on the second opposing surface are positioned on one side of the receptacle.

16. The method of displaying drapery according to claim 15, further comprising mounting the support surface onto the pre-existing display fixture, wherein the mounting the support surface on the pre-existing display fixture comprises applying pressure to the first bracket and the second bracket on the support surface such that protrusions in the first bracket and second bracket deform to allow the pre-existing display fixture to enter the receptacle.

* * * * *